US012102863B1

(12) United States Patent
Song

(10) Patent No.: US 12,102,863 B1
(45) Date of Patent: Oct. 1, 2024

(54) DEVICE FOR FIXING MOVEMENT TRACK OF BARBELL BAR INSTALLED ON SQUAT RACK

(71) Applicant: Yongliang Song, Henan (CN)

(72) Inventor: Yongliang Song, Henan (CN)

( * ) Notice: Subject to any disclaimer, the term of this patent is extended or adjusted under 35 U.S.C. 154(b) by 0 days.

(21) Appl. No.: 18/674,749

(22) Filed: May 24, 2024

(30) Foreign Application Priority Data

Oct. 31, 2023 (CN) ..... 202322936289.5

(51) Int. Cl.
*A63B 21/062* (2006.01)
*A63B 21/00* (2006.01)
*A63B 21/072* (2006.01)
*A63B 23/04* (2006.01)

(52) U.S. Cl.
CPC ..... *A63B 21/0626* (2015.10); *A63B 21/0724* (2013.01); *A63B 21/4045* (2015.10); *A63B 23/0405* (2013.01); *A63B 2023/0411* (2013.01); *A63B 2225/093* (2013.01)

(58) Field of Classification Search
CPC ..... A63B 21/062; A63B 21/0626; A63B 21/0632; A63B 21/0724; A63B 21/0728; A63B 21/4045; A63B 23/0405; A63B 2023/0411
See application file for complete search history.

(56) References Cited

U.S. PATENT DOCUMENTS

| | | | | |
|---|---|---|---|---|
| 5,651,758 | A * | 7/1997 | Cervantes | A63B 21/078 482/93 |
| 11,235,192 | B1 * | 2/2022 | Thomas | A63B 21/078 |
| 11,759,670 | B2 * | 9/2023 | Hsu | A63B 71/0036 482/104 |
| 2016/0213966 | A1 * | 7/2016 | Chou | A63B 21/0783 |
| 2018/0272176 | A1 * | 9/2018 | Aasa | A63B 21/0628 |
| 2020/0188723 | A1 * | 6/2020 | Reibman | A63B 21/0724 |
| 2022/0233908 | A1 * | 7/2022 | Neuhaus | A63B 21/078 |
| 2022/0305323 | A1 * | 9/2022 | Larson | A63B 71/0054 |

* cited by examiner

*Primary Examiner* — Zachary T Moore
(74) *Attorney, Agent, or Firm* — Hawaii Patent Services; Nathaniel K. Fedde; Kenton N. Fedde

(57) ABSTRACT

The present invention relates to a device for fixing the movement track of a barbell bar mounted on a squat rack, which comprises two sliding mounting seats, wherein the two sliding mounting seats are respectively arranged on the left and right sides of a squat rack body, and two groups of first sliding shafts are arranged between the two sliding mounting seats, and the two groups of first sliding shafts are both fitted tightly with the squat rack body, and the two sliding mounting seats are provided with fixing mechanisms for fixing barbell bars; the fixing mechanism comprises a fixing seat corresponding to the sliding mounting seat, and both a clamping seat and the fixing seat are provided with at least one second sliding shaft, and the axial direction of the second sliding shaft is parallel to the axial direction of the barbell bar.

17 Claims, 12 Drawing Sheets

DEVICE FOR FIXING MOVEMENT TRACK OF BARBELL BAR INSTALLED ON SQUAT RACK

CROSS-REFERENCE TO RELATED APPLICATIONS

This application claims the benefit of priority from Chinese Patent Application No. 202322936289.5 filed on Oct. 31, 2023, the contents of which are hereby incorporated by reference in their entirety.

TECHNICAL FIELD

The present invention relates to the technical field of fitness equipment, in particular to a device for fixing the movement track of a barbell bar installed on a squat rack.

BACKGROUND

Squat rack is a necessary comprehensive exercise equipment for fitness enthusiasts, and different functions can be realized by installing different accessories. One of the accessories is called the squat rack trolley system, which can slide up and down along the column of the squat rack and can be connected with the barbell bar. However, the connection mode is fixed, which makes it difficult for the barbell bar to rotate and cannot achieve more exercise actions.

For example, in the trolley system disclosed in U.S. patent Ser. No. 11/896,867, the connection between the barbell bar and the trolley system is fixed, so the barbell bar cannot be rotated well, and the user cannot achieve more exercise actions. Similarly, in the fitness machine system and using method disclosed in U.S. Pat. No. 11,517,785, the connection between the barbell bar and the squat rack trolley system is also fixed, and the barbell bar cannot be rotated well, so the user cannot realize more exercise actions.

Based on the above, it is necessary to put forward a new type of device for fixing a barbell bar on squat rack, which can realize smooth rotation of barbell bar, expand more exercise movements and improve the user's experience.

SUMMARY

The present invention provides a device for fixing the movement track of a barbell bar mounted on a squat rack, which includes two sliding mounting seats, which are respectively arranged on left and right sides of a squat rack body, wherein two groups of first sliding shafts are arranged between the two sliding mounting seats, and the two groups of first sliding shafts are respectively arranged on front and back sides of a squat rack; the two groups of first sliding shafts are both fitted tightly with the squat rack body, and the two sliding mounting seats are provided with fixing mechanisms for fixing the barbell bar; and the fixing mechanism comprises a fixing seat corresponding to the sliding mounting seat, and the fixing seat is fixedly connected with the sliding mounting seat; the fixing seat is provided with a mounting groove adapted to a shape of the barbell bar; an clamping seat is mounted on a top of the fixing seat, and the clamping seat is matched with the mounting groove on the fixing seat to form an annular structure adapted to the shape of the barbell bar; the clamping seat and the fixing seat are connected and fixed by an adjusting mechanism; and wherein, both the clamping seat and the fixing seat are provided with at least one second sliding shaft, and an axial direction of the second sliding shaft is parallel to an axial direction of the barbell bar.

Further, the adjusting mechanism comprises a U-shaped clipping seat; one end of the clamping seat is hinged with the fixing seat, and the U-shaped clipping seat is fixedly connected with the other end of the clamping seat; the fixing seat is hinged with a threaded rod, and a rotating direction of the threaded rod corresponds to a position of the U-shaped clipping seat, and the threaded rod is provided with a threadedly connected nut.

Further, the clamping seat and the fixing seat are hinged by a hinge shaft, the clamping seat is provided with a strip groove, the hinge shaft is connected in the strip groove, and the hinge shaft is fixedly installed on the fixing seat.

Further, the fixing seat is provided with third pin holes for connecting the hinge shaft, and there are at least two third pin holes.

Further, the adjusting mechanism comprises two pin bars, at least two first pin holes are formed on both sides of the mounting groove of the fixing seat, and two ends of the clamping seat are provided with second pin holes corresponding to the first pin holes; dimensions of the pin bars are matched with those of the first pin holes and the second pin holes, and the movable ends of the pin bars are provided with fixing pins.

Further, the device further comprises a collar, wherein a dimension of the collar is adapted to a dimension of the barbell bar, and the collar is sleeved and fixedly connected to the barbell bar, and a hook is connected to the collar.

Further, at least two fourth pin holes are arranged along a height direction at one end of the mounting groove of the fixing seat hinged with the clamping seat.

Further, fifth pin holes corresponding to the fourth pin holes are arranged on the clamping seat, and the fifth pin holes are arranged as roughly racetrack-shaped holes, and the fixing seat and the clamping seat are hinged through a fixing pin.

Further, the device further comprises an attachment rack attached to the squat rack body and arranged above the relatively sliding mounting seat; and the attachment rack is provided with a clamping part which is fixedly connected with the attachment rack, and the clamping part is provided with an attachment groove which is used for clamping the hook.

Further, a plurality of first fixing holes are uniformly arranged along the length direction of the squat rack body, and second fixing holes corresponding to the first fixing holes are arranged on the attachment rack, and the squat rack body and the attachment rack are fixedly connected through an attachment member.

Further, the attachment rack has a cross section that is roughly U-shaped.

Further, the fixing seat comprises a first pin plate, a fixing front plate and a fixing rear plate; the fixing front plate is fixedly connected with the sliding mounting seat, at least one first fixing pin hole is arranged on the fixing front plate, and at least one second fixing pin hole corresponding to the first fixing pin hole is arranged on the fixing rear plate; and first connecting parts corresponding to the first and second fixing pin holes are formed at both ends of the first pin plate, and the fixing front plate and the fixing rear plate are detachably connected through the first pin plate.

Further, the device further comprising a rotating pin, wherein a first rotating hole is arranged in the second sliding shaft, at least one second rotating hole corresponding to the first rotating hole is arranged on the fixing front plate, and at least one third rotating hole corresponding to the second rotating hole is arranged on the fixing rear plate; and the fixing seat and the second sliding shaft are rotationally connected through the rotating pin, the first rotating hole and the second rotating hole.

Further, the clamping seat comprises a second pin plate, a clamping front plate and a clamping rear plate; the clamping front plate is provided with at least one third fixing pin hole, and the clamping rear plate is provided with at least one fourth fixing pin hole corresponding to the third fixing pin hole; second connecting parts corresponding to the third fixing pin hole and the fourth fixing pin hole are formed at both ends of the second pin plate, and the clamping front plate and the clamping rear plate are detachably connected through the second pin plate.

Further, at least one fourth rotating hole corresponding to the first rotating hole is arranged on the clamping front plate, and at least one fifth rotating hole corresponding to the fourth rotating hole is arranged on the clamping rear plate; the clamping seat and the second sliding shaft are rotationally connected through the rotating pin, the fourth rotating hole, the fifth rotating hole and the first rotating hole.

Further, a plurality of first fixing holes are uniformly arranged along the length direction of the squat rack body, and the ends of the two sliding mounting seats close to the fixing mechanism are connected with locking plates; locking holes are arranged in the locking plates, the locking holes correspond to the first fixing holes, and the locking holes extend to form locking parts with a hollow structure.

Further, the device further comprising a collar, wherein the dimension of the collar is matched with the dimension of the barbell bar, the collar is sleeved and fixedly connected to the barbell bar, and a locking component is arranged on the collar; and the locking component comprises a locking connecting rod and a locking block, wherein one end of the locking connecting rod is hinged with the collar, and the other end of the locking connecting rod is hinged with the locking block, and the locking block is configured to slidably pass through the locking part.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
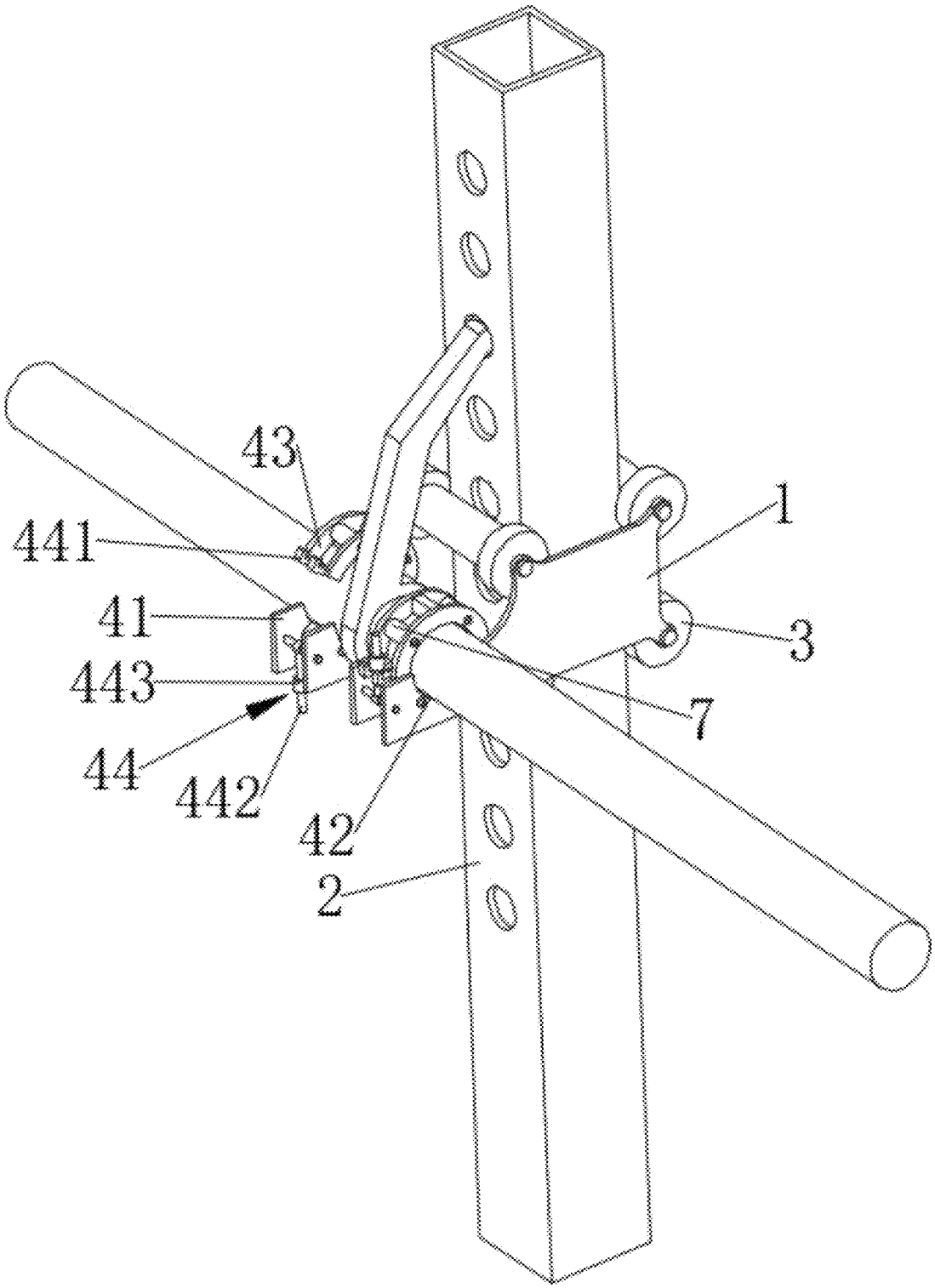
FIG. 1 is a schematic diagram of Embodiment 1.
Figure 2:
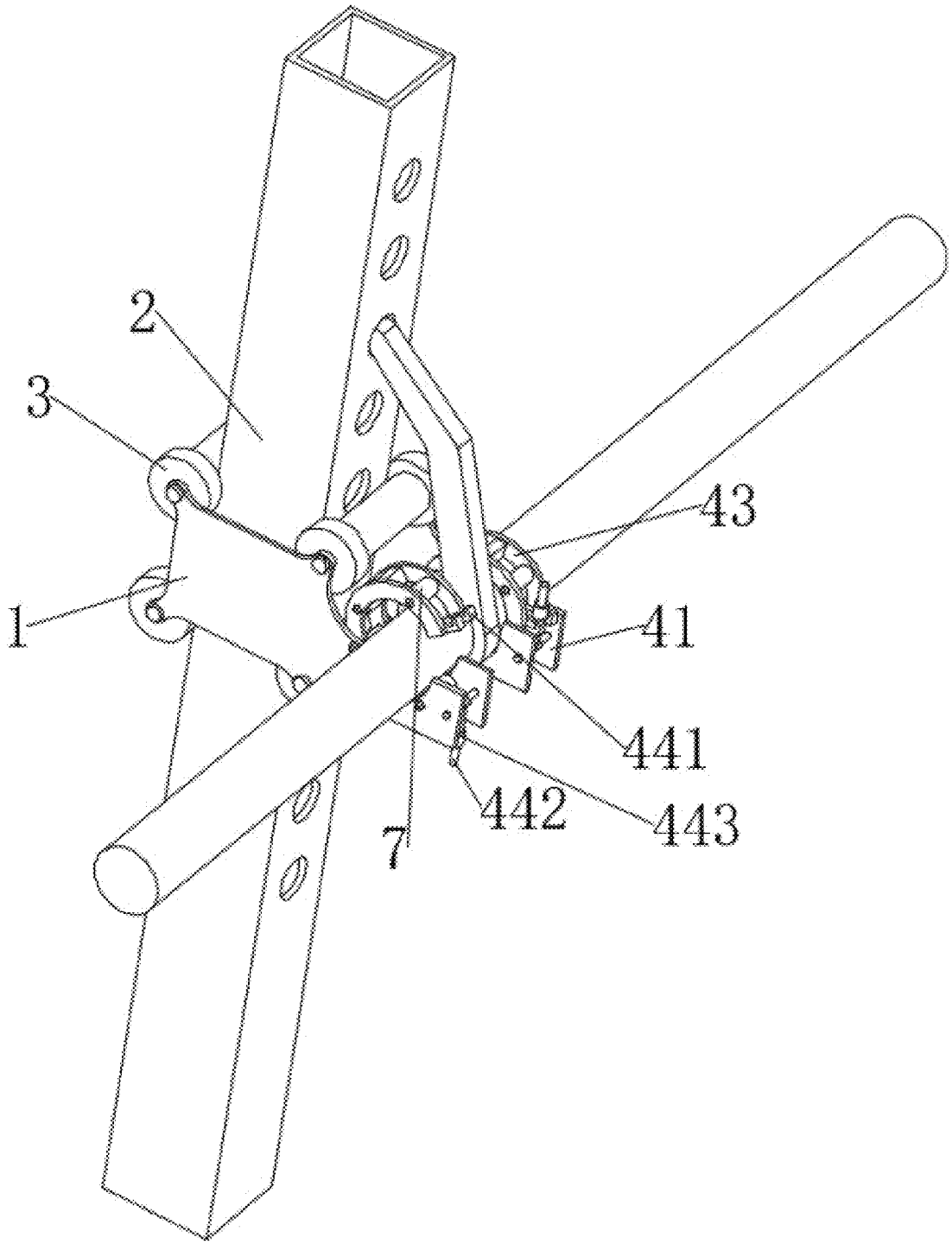
FIG. 2 is another schematic diagram of Embodiment 1.
Figure 3:
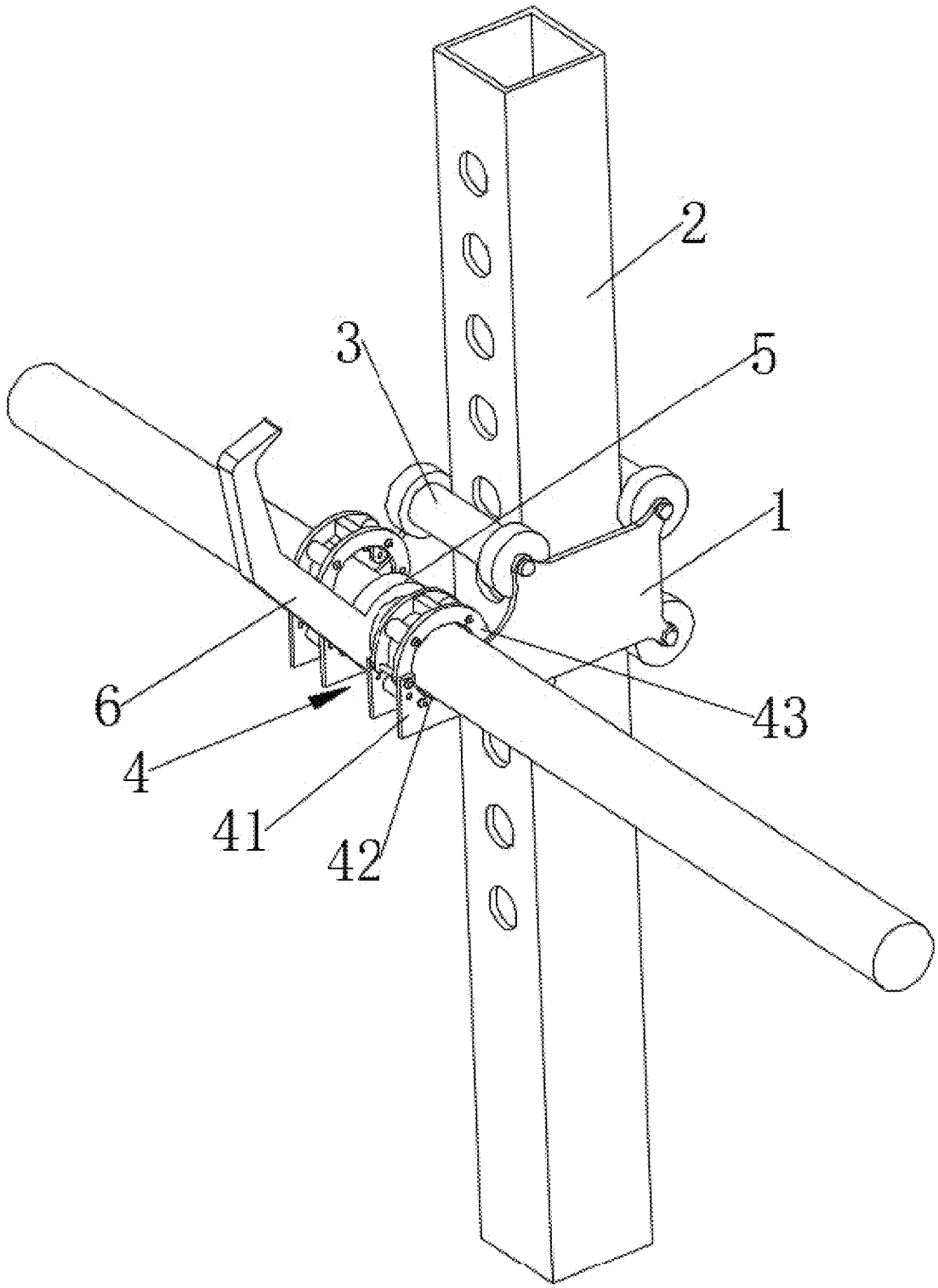
FIG. 3 is a schematic diagram of Embodiment 2.
Figure 4:
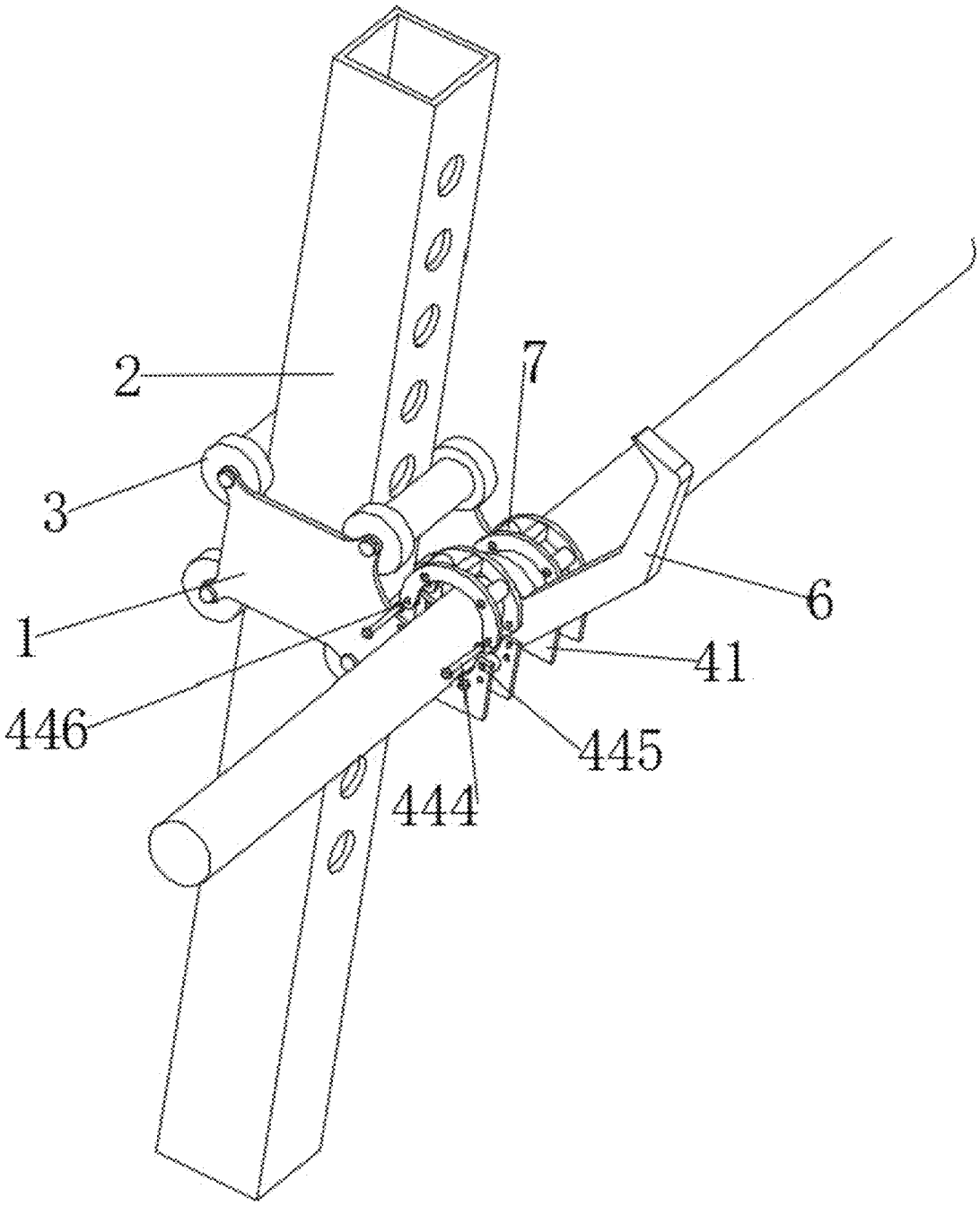
FIG. 4 is another schematic diagram of Embodiment 2.

IN THE FIGURES:

Sliding mounting seat (1); Squat rack body (2); First fixing hole (21); First sliding shaft (3); Fixing mechanism (4); Fixing seat (41); First pin plate (411); Fixing front plate (412); Fixing rear plate (413); First fixing pin hole (414); Second fixing pin hole (415); First connecting part (416); Rotating pin (417); First rotating hole (418); Second rotating hole (419); Third rotating hole (4111); Mounting groove (42); Clamping seat (43); Second pin plate (431); Clamping front plate (432); Clamping rear plate (433); Third fixing pin hole (434); Fourth fixing pin hole (435); Second connecting part (436); Fourth rotating hole (437); Fifth rotating hole (438); Adjusting mechanism (44); U-shaped clipping seat (441); Threaded rod (442); Nut (443); Pin rod (444); First pin hole (445); Second pin hole (446); Fourth pin hole (447); Fifth pin hole (448); Collar (5); Hook (6); Second sliding shaft (7); Attachment rack (8); Clamping part (81); Attachment groove (811); Second fixing hole (82); Fixing pin (83); Attachment member (84); Locking plate (2000); Locking part (2100); Locking hole (2110); Locking component (2200); Locking connecting rod (2210); Locking block (2220).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As shown in FIGS. 1 to 4, a device for fixing the movement track of a barbell bar installed on a squat rack disclosed by the present invention comprises two sliding mounting seats 1, which are respectively arranged on the left and right sides of a squat rack body 2; two groups of first sliding shafts 3 are arranged between the two sliding mounting seats 1, and the two groups of first sliding shafts 3 are respectively arranged on the front and rear sides of the squat rack; the two groups of first sliding shafts 3 are both fitted tightly with the squat rack body 2, and the two sliding mounting seats 1 are provided with fixing mechanisms for fixing the barbell bar.

The two groups of first sliding shafts 3 are connected between the two sliding mounting seats 1 in a sliding way. During the sliding mounting seats 1 moving up and down along the squat rack, the first sliding shafts 3 can roll along the squat rack body 2, which can play a guiding role in the user's use process, and at the same time, the barbell bar can be restricted from moving in other directions to prevent harm to the user.

In this embodiment, each group of first sliding shafts 3 includes two rollers, and two groups of four rollers form a quadrilateral frame, which is sleeved on the squat rack body 2.

The fixing mechanism 4 includes a fixing seat 41 corresponding to the sliding mounting seat 1, and the fixing seat 41 is fixedly connected with the sliding mounting seat 1; the fixing seat 41 is provided with a mounting groove 42 adapted to a shape of the barbell bar; an clamping seat 43 is mounted on a top of the fixing seat 41, and the clamping seat 43 is matched with the mounting groove 42 on the fixing seat 41 to form an annular structure adapted to the shape of the barbell bar; the clamping seat 43 and the fixing seat 41 are connected and fixed by an adjusting mechanism 44.

The above fixing seat 41 is fixedly connected with the sliding mounting seat 1, or can be integrally formed, so that the stability is stronger.

The mounting groove 42 is used to place and support the barbell bar, and the clamping seat 43 at the top of the fixing seat 41 is used to fix the barbell bar above. The clamping seat 43 and the mounting groove 42 on the fixing seat 41 form a structure which is adapted to the shape of the barbell bar and slightly larger than the diameter of the barbell bar, so that the barbell bar can be rotated after being placed in the mounting groove 42 and fixed by the clamping seat 43. In order to rotate the barbell bar more labor-saving, both the clamping seat 43 and the fixing seat 41 are provided with at least one second sliding shaft 7, and the axial direction of the second sliding shaft 7 is parallel to the axial direction of the barbell bar.

Specifically, as shown in FIGS. 5 to 10, in this embodiment, the fixing seat 41 includes a first pin plate 411, a fixing front plate 412 and a fixing rear plate 413. The fixing front plate 412 is fixedly connected with the sliding mounting seat 1, and at least one first fixing pin hole 414 is provided on the fixing front plate 412, and at least one second fixing pin hole 415 corresponding to the first fixing pin hole 414 is provided on the fixing rear plate 413. First connecting parts 416 corresponding to the first and second fixing pin holes are formed at both ends of the first pin plate 411, and the fixing front plate 412 and the fixing rear plate 413 are detachably connected through the first pin plate 411.

In other embodiments (not shown in the figure), the fixing front plate and the fixing rear plate are not limited to being connected by the above-mentioned connection methods, but also can be connected by the screw thread of the fixing member, the pin connection, the rivet connection, the integral molding, the welding and any other connection methods as desired.

Figure 8:
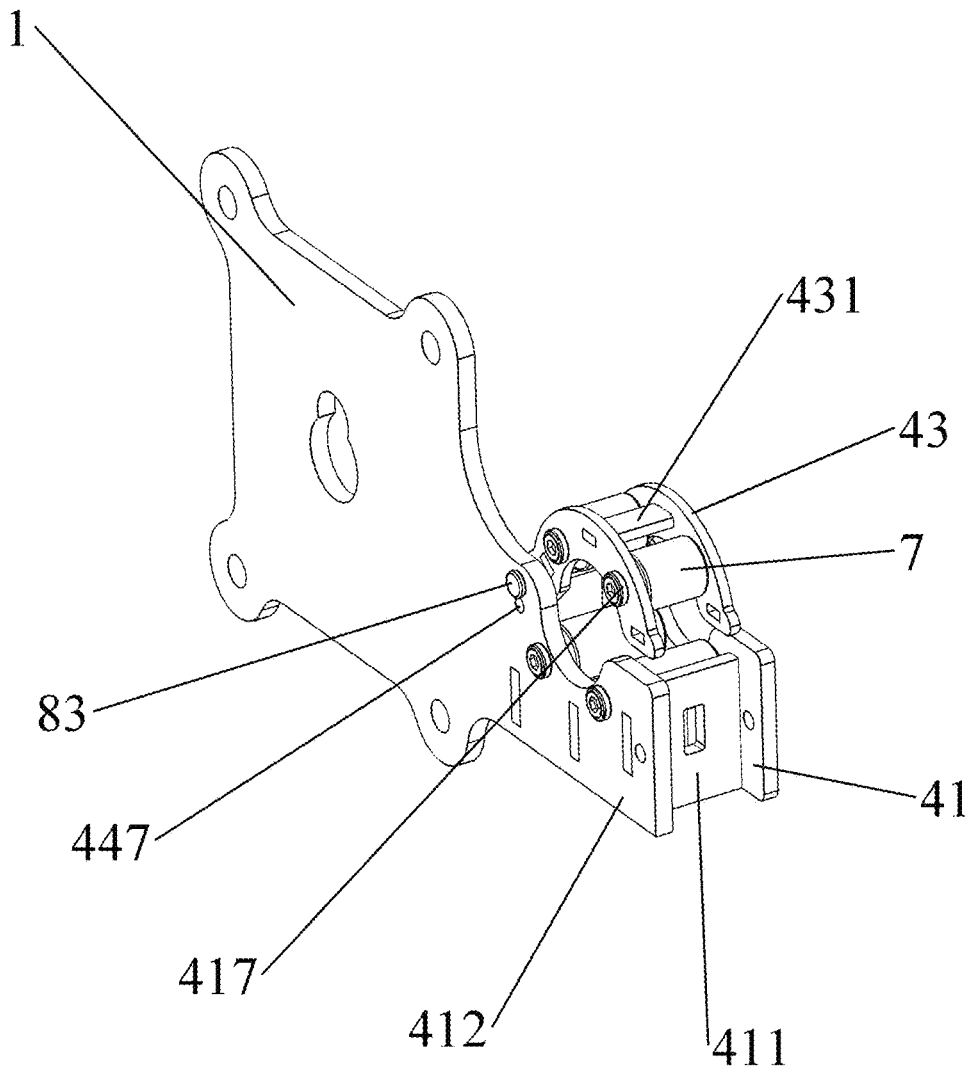
FIG. 8 is a partial schematic view of FIG. 5.
Figure 9:
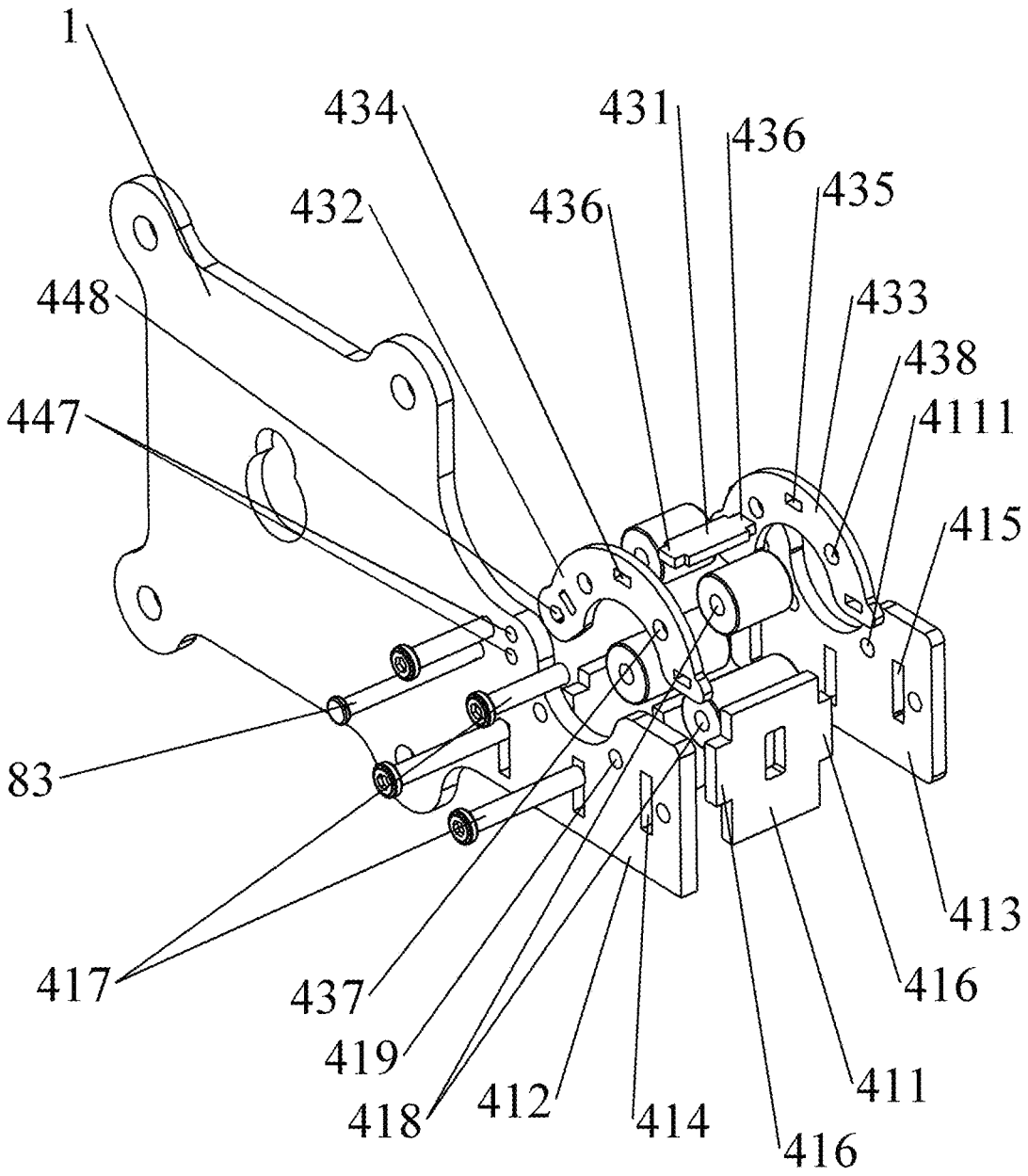
FIG. 9 is an exploded view of FIG. 8.

As shown in FIGS. 8 to 9, this embodiment further includes a rotating pin 417. The second sliding shaft 7 is provided with a first rotating hole 418, the fixing front plate is provided with at least one second rotating hole 419 corresponding to the first rotating hole 418, and the fixing rear plate is provided with at least one third rotating hole 4111 corresponding to the second rotating hole 419. The fixing seat 41 and the second sliding shaft 7 are rotationally connected through the rotating pin 417, the first rotating hole 418, the second rotating hole 419 and the third rotating hole 4111.

In other embodiments (not shown in the figure), the fixing seat and the second sliding shaft are not limited to being connected by the above-mentioned connection methods, but can also be connected by the screw thread of the fixing member, the rivet connection, and any desired connection methods.

As shown in FIGS. 8 to 9, in this embodiment, the clamping seat 43 comprises a second pin plate 431, a clamping front plate 432 and a clamping rear plate 433, wherein the clamping front plate 432 is provided with at least one third fixing pin hole 434, and the clamping rear plate 433 is provided with at least one fourth fixing pin hole 435 corresponding to the third fixing pin hole 434; second connecting parts 436 corresponding to the third fixing pin hole 434 and the fourth fixing pin hole 435 are formed at both ends of the second pin plate 431, and the clamping front plate 432 and the clamping rear plate 433 are detachably connected through the second pin plate 431.

In other embodiments (not shown in the figure), the clamping front plate and the clamping rear plate are not limited to being connected by the above-mentioned connection mode, but also can be connected by the screw thread of the fixing member, the pin connection, the rivet connection, and can also be set to be integral molding, welding and any other connection mode as desired.

As shown in FIGS. 8 to 9, in this embodiment, the clamping front plate 432 is provided with at least one fourth rotating hole 437 corresponding to the first rotating hole 418, and the clamping rear plate 433 is provided with at least one fifth rotating hole 438 corresponding to the fourth rotating hole 437. The clamping seat 43 and the second sliding shaft 7 are rotationally connected through the rotation pin 417, the fourth rotating hole 437, the fifth rotating hole 438 and the first rotating hole 418.

In other embodiments (not shown in the figure), the clamping seat and the second sliding shaft are not limited to being connected by the above-mentioned connection mode, but can also be connected by the screw thread of the fixing member, the rivet connection, and any other connection mode as desired.

The second sliding shaft 7 is rotatably connected with the clamping seat 43 and the fixing seat 41, so that the barbell bar can rotate relatively in the rotation process, reducing the friction force and saving labor. Further, when the user uses the device for fixing the movement track of the barbell bar installed on the squat rack to exercise, the fitness efficiency of squat can be effectively improved. When the user squats to different heights, the body center of gravity will change to a certain extent, and at this time, the user needs to adjust the angle of grasping the barbell bar by hand to adjust his center of gravity and force exerting state.

In some embodiments, the adjusting mechanism 44 includes a U-shaped clipping seat 441; one end of the clamping seat 43 is hinged with the fixing seat 41, and the U-shaped clipping seat 441 is fixedly connected with the other end of the clamping seat 43; the fixing seat 41 is hinged with a threaded rod 442, and a rotating direction of the threaded rod 442 corresponds to a position of the U-shaped clipping seat 441, and the threaded rod 442 is provided with a threadedly connected nut 443.

In the adjusting mechanism 44, one end of the clamping seat 43 is hinged on the fixing seat 41, so that it can be opened or closed around the fixing seat 41. For fixing the barbell bar after the clamping seat 43 is closed, a U-shaped clipping seat 441 is arranged at the front end of the clamping seat 43, and a threaded rod 442 is installed at the corresponding position on the fixing seat 41, and the threaded rod 442 is hinged with the fixing seat 41. After the threaded rod 442 is rotated to the vertical state, it is just placed between the U-shaped clipping seat 441. A nut 443 is arranged on the threaded rod 442, and the nut 443 is rotated so that the nut 443 is clamped on the top of the U-shaped clipping seat 441, so that the clamping seat 43 can be fixed and closed with the fixing seat 41 to form an annular structure for fixing the barbell bar.

The setting of the adjusting mechanism 44 can not only realize the disassembly and assembly of the barbell bar, but also be adjusted according to the specifications (diameter) of the barbell bar by adjusting the position of the nut 443. In order to further ensure the stability of the barbell bar, the clamping seat 43 and the fixing seat 41 are hinged by a hinge shaft, and the clamping seat 43 is provided with a strip groove, and the hinge shaft is connected in the strip groove, and the hinge shaft is fixedly installed on the fixing seat 41.

It can also be arranged that the fixing seat 41 is provided with third pin holes for connecting the hinge shaft, and there are at least two third pin holes.

According to the diameter of the barbell bar, the connection position of the hinge shaft can be adjusted, and with the rotation of the U-shaped clipping seat 441, the clamping seat 43 can be ensured to fit the barbell bar as much as possible to ensure stability.

Figure 10:
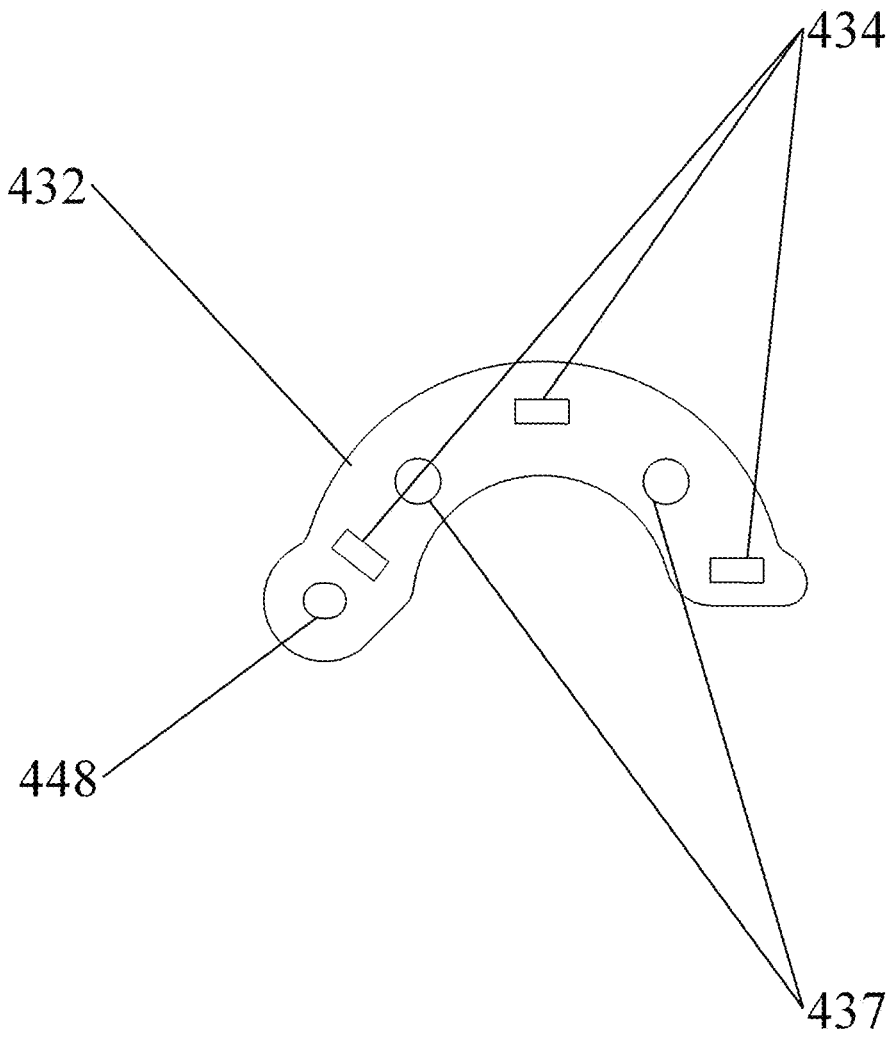
FIG. 10 is a schematic view of clamping the front plate.

As shown in FIGS. 8 to 10, in some embodiments, at least two fourth pin holes 447 are provided at one end of the mounting groove 42 of the fixing seat 41 hinged with the clamping seat 43 along the height direction. The clamping seat 43 is provided with a fifth pin hole 448 corresponding to the fourth pin hole 447, and the fifth pin hole 448 is arranged as a roughly racetrack-shaped hole, and the fixing seat 41 and the clamping seat 43 are hinged through a fixing pin 83.

When clamping barbell bars with different dimensions, users can select different fourth pin holes to use barbell bars with different dimensions. Wherein, the fifth pin hole is arranged in a racetrack shape, so that when the fixing seat and the clamping seat clamp barbell bars with different dimensions, the state of the clamping seat can be adjusted to a certain extent, so that the barbell bar fully abuts against the second sliding shaft, and the rotation is smoother.

In this embodiment, the fifth pin hole is arranged in a substantially racetrack shape. In other embodiments, the fifth pin hole is not limited to the racetrack shape, but can also be set as a circle, a square, an ellipse, a semicircle, a polygon, a triangle, and any desired geometric shape.

In other embodiments, the adjusting mechanism 44 includes two pin rods 444, at least two first pin holes 445 are formed on both sides of the mounting groove 42 of the fixing seat 41, and two ends of the clamping seat 43 are provided with a second pin hole 446 corresponding to the first pin hole 445. The dimensions of the pin rods 444 are adapted to those of the first pin holes 445 and the second pin holes 446, and the movable end of the pin rod 444 is provided with a fixing bolt.

Both ends of the fixing seat 41 connected with the clamping seat 43 are provided with first pin holes 445, and there are at least two first pin holes 445 at each end, and both ends of the clamping seat 43 are provided with second pin holes 446. The first pin holes 445 and the second pin holes 446 have the same dimension. When the first pin hole 445 corresponds to the second pin hole 446, the pin rod 444 and the bolt (detachable) on the pin rod 444 are inserted to disassemble the barbell rod. For barbell rods with different specifications (diameters), it only needs to allow the second pin holes 446 at both ends to correspond to the different first pin holes 445.

Further, the device further comprises a collar 5, the dimension of which is matched with that of the barbell bar, the collar 5 is sleeved and fixedly connected to the barbell bar, and the collar 5 is connected with a hook 6.

The above-mentioned collar 5 is used to be sleeved (fixed) on the barbell bar, and the fixing sleeve can be in the form of a hoop or in other ways, so long as it can be detached from the barbell bar. The hook 6 is fixed on the collar 5, and several deep holes for hanging the hook 6 are opened in the squat rack body 2 along the height direction;

When in use, the user only needs to rotate the barbell bar outward to turn the hook 6 out of the deep hole, then reverse the barbell bar after use and hang the hook 6 in the deep hole again. Even when physical strength is exhausted during use, it only needs to rotate the barbell bar at any time and hang the hook 6 on the squat rack body 2. After fixing, the user can leave the squat rack and adjust it to an appropriate height when using it again.

Figure 5:
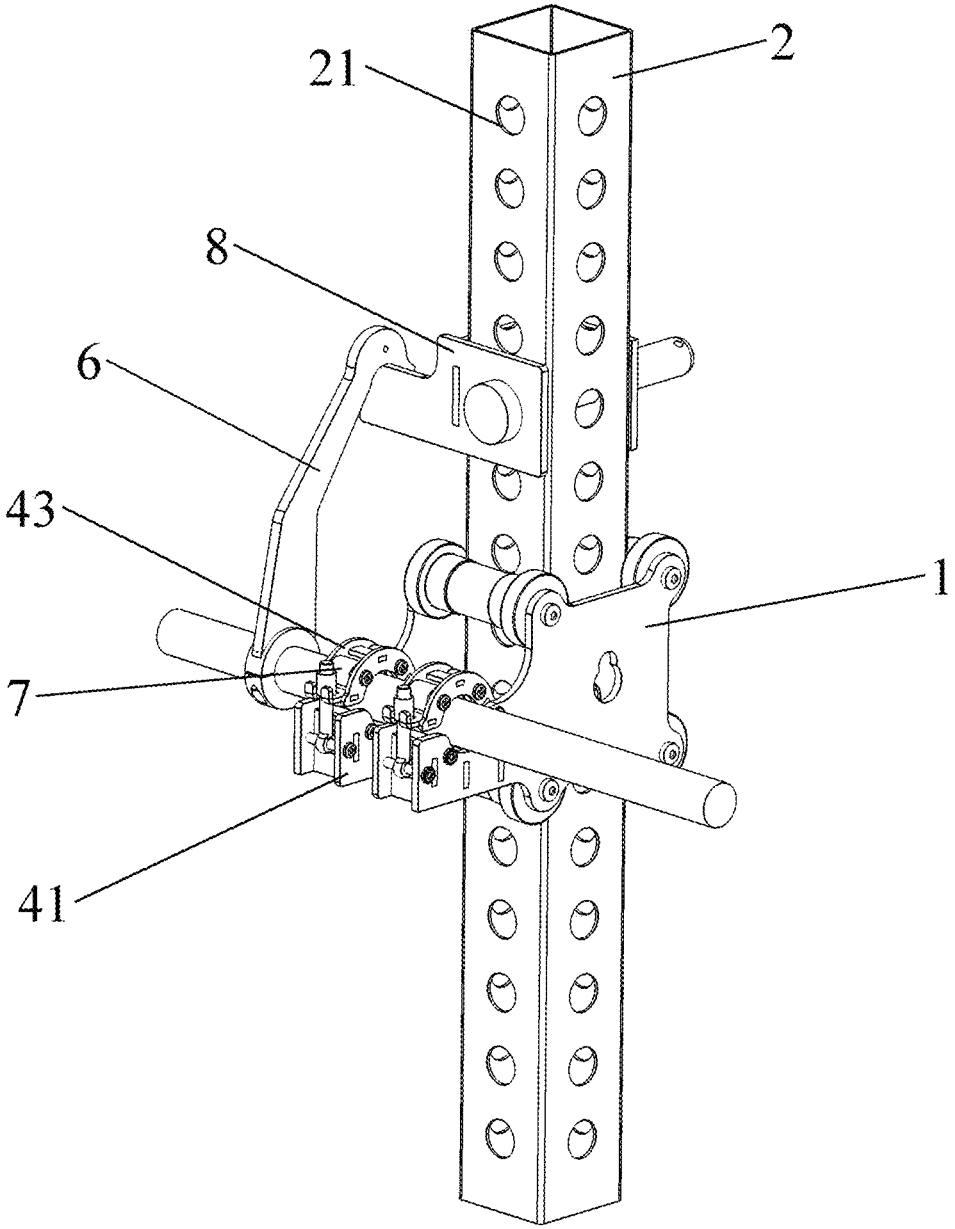
FIG. 5 is a schematic diagram of Embodiment 3.
Figure 6:
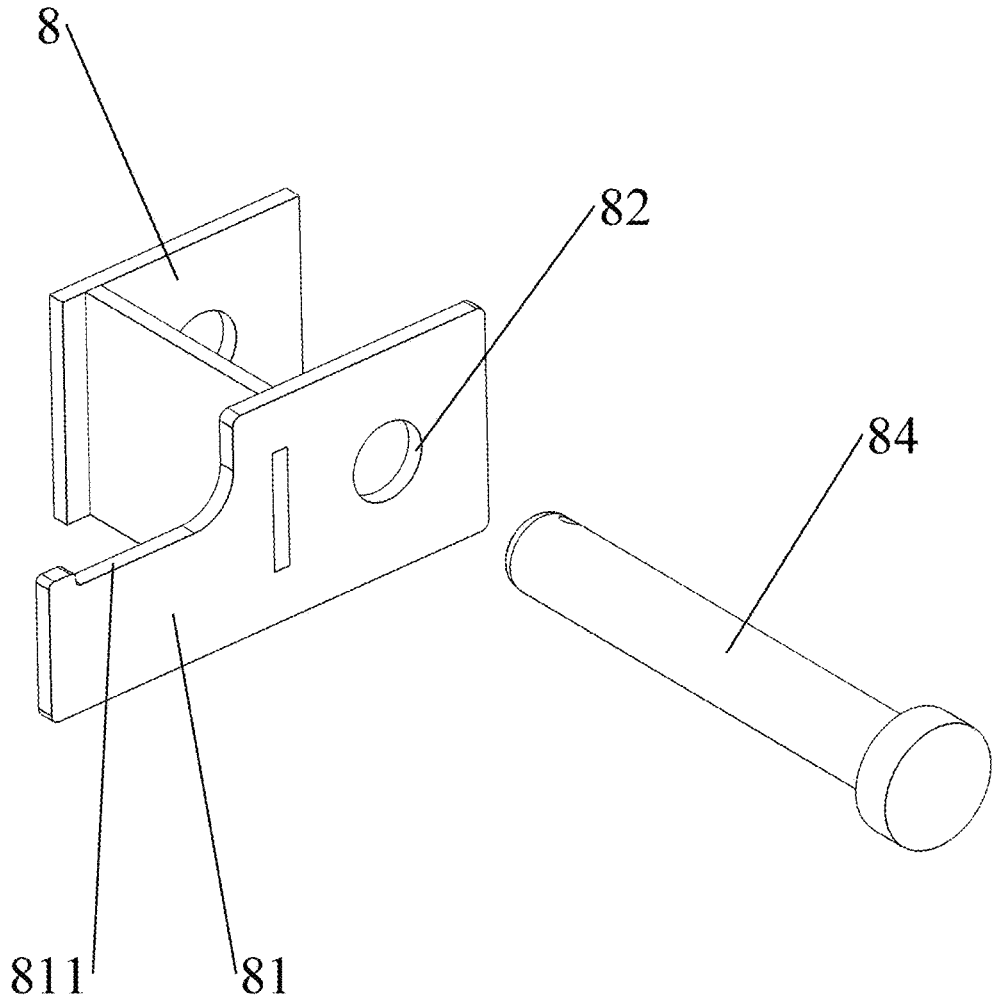
FIG. 6 is a schematic view of an attachment rack.
Figure 7:
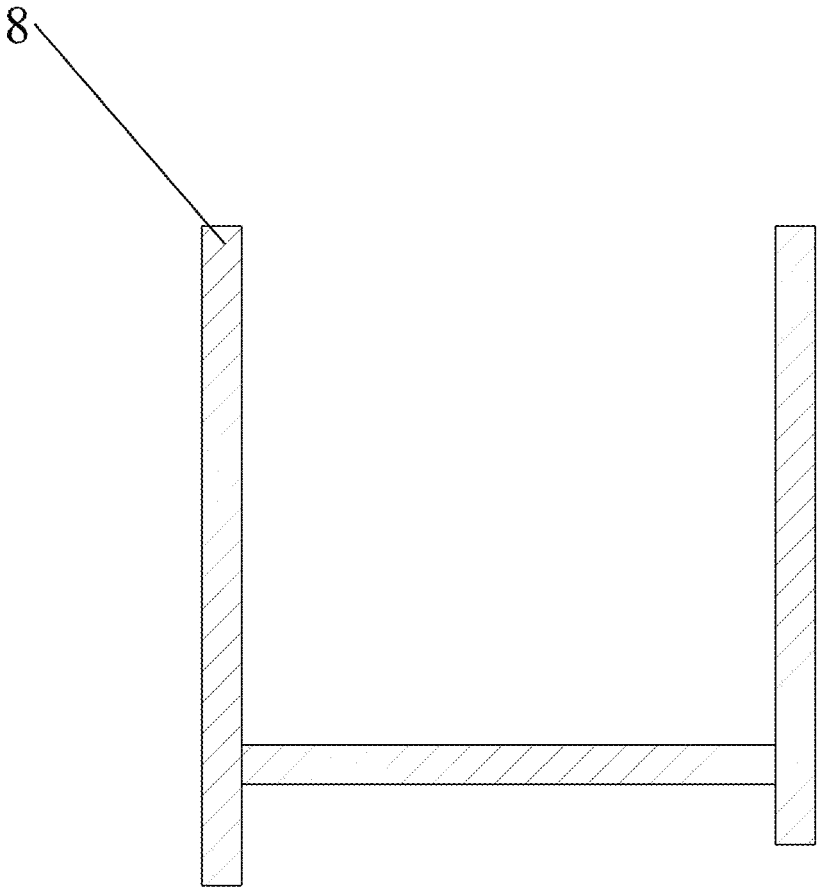
FIG. 7 is a sectional view of the attachment rack.

As shown in FIGS. 5 to 7, in some embodiments, the device further includes an attachment rack 8, which is attached to the squat rack body 2 and arranged above the relatively sliding mounting seat 1; the attachment rack 8 is provided with a clamping part 81 which is fixedly connected with the attachment rack 8, and the clamping part 81 is provided with an attachment groove 811 for clamping the hook 6.

Specifically, a plurality of first fixing holes 21 are evenly distributed with along the length direction of the squat rack body 2, and the attachment rack 8 is provided with second fixing holes 82 corresponding to the first fixing holes 21, and the squat rack body 2 and the attachment rack 8 are fixedly connected through an attachment member 84, wherein the attachment rack has a cross section in a roughly U shape.

When in use, the user first connects the attachment rack to a proper position on the squat rack, and when the physical strength is exhausted, the barbell bar is rotated to drive the hook, and the hook is clamped on the clamping groove. Compared with the above-mentioned embodiments, this embodiment has the advantages that the attachment rack is externally connected to the squat rack, which can increase the probability that the hook is stuck in the clamping groove, so as to avoid being unable to hook into the deep hole when the physical strength is exhausted, and the safety is higher.

Figure 11:
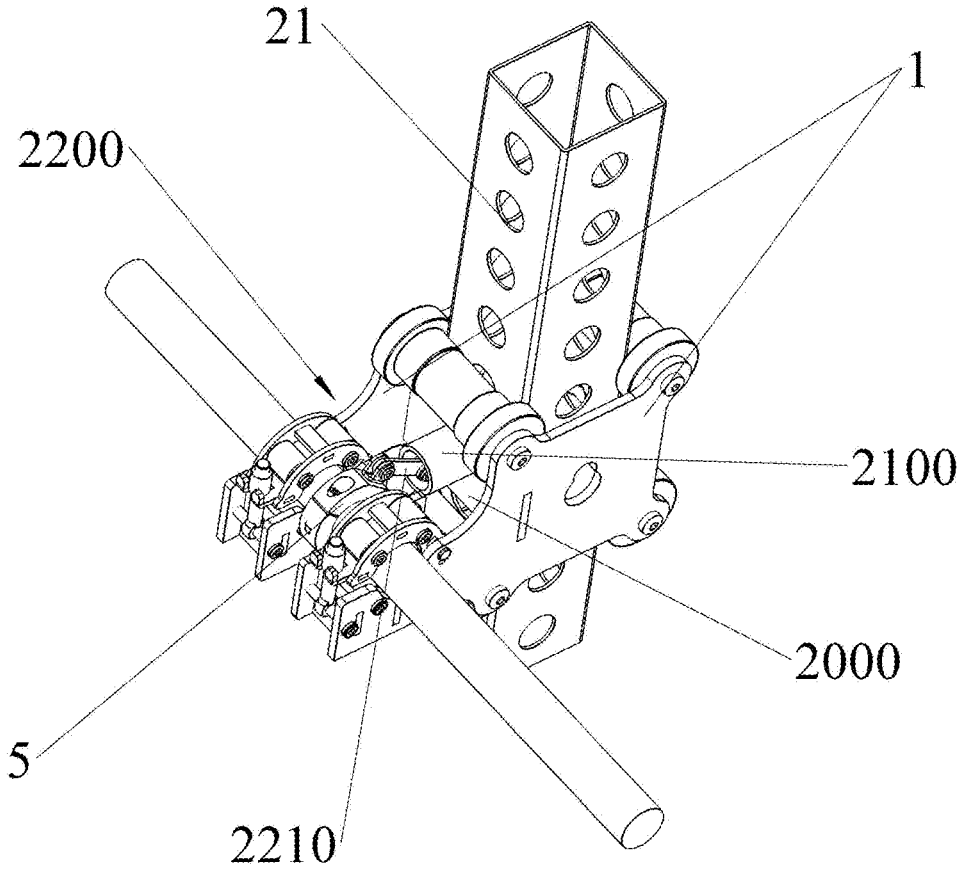
FIG. 11 is a schematic diagram of Embodiment 4.
Figure 12:
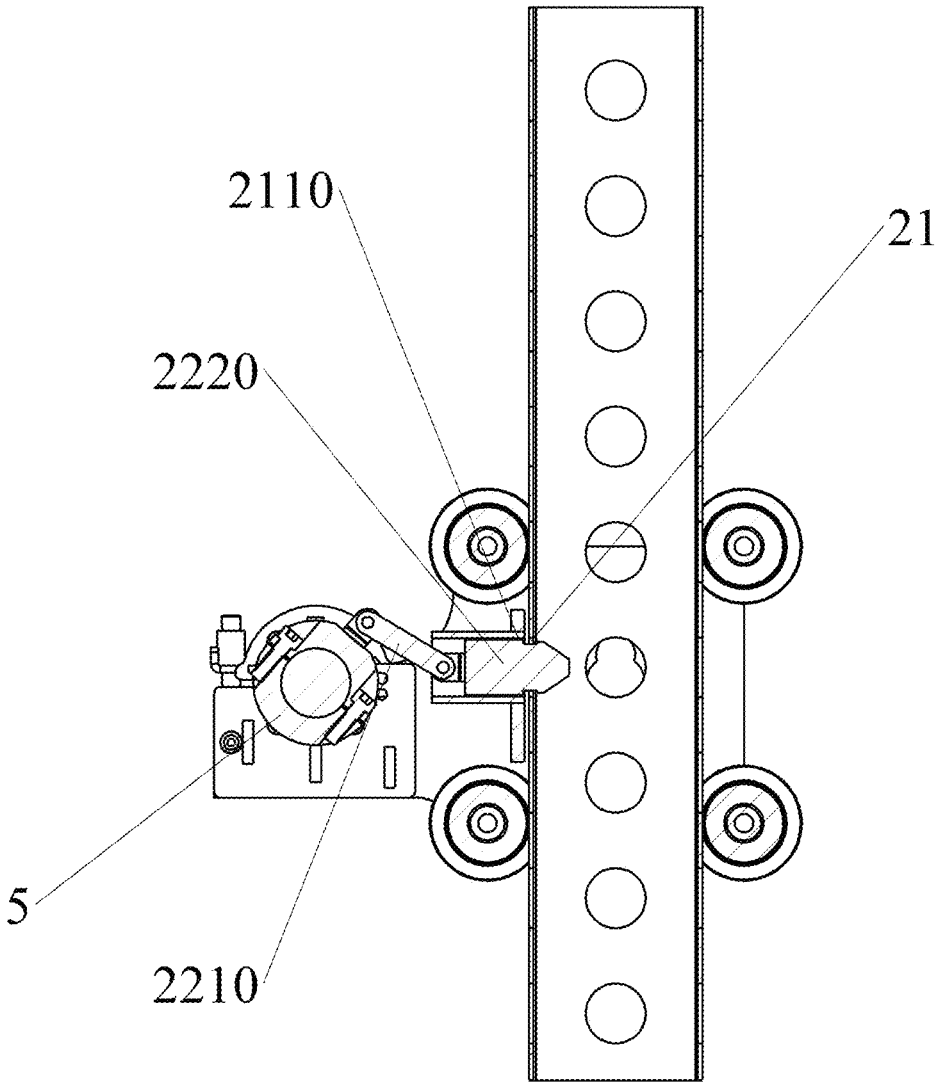
FIG. 12 is a sectional view of FIG. 11.

As shown in FIG. 11 and FIG. 12, in the fourth embodiment, locking plates 2000 are connected to the ends of the two sliding mounting seats 1 near the fixing mechanism 4, and locking holes 2110 are formed in the locking plates 2000, which correspond to the first fixing holes 21, and a locking part 2100 with a hollow structure is formed by extending the locking hole 2110.

In this embodiment, the device further includes a collar 5, the dimension of which is adapted to that of the barbell bar. The collar 5 is sleeved and fixedly connected to the barbell bar, and a locking component 2200 is arranged on the collar 5; the locking component 2200 includes a locking connecting rod 2210 and a locking block 2220; one end of the locking connecting rod 2210 is hinged with the collar 5, the other end of the locking connecting rod 2210 is hinged with the locking block 2220, and the locking block 2220 is configured to slidably pass through the locking part 2100.

Specifically, the locking block is arranged in the locking part and corresponds to the first fixing hole and the locking hole. When in use, the user only needs to rotate the barbell bar outward to rotate the locking block out of the first fixing hole, then reverse the barbell bar after use, and insert the locking block into the locking hole and then into the first fixing hole.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for case of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A device for fixing a movement track of a barbell bar installed on a squat rack, comprising:

two sliding mounting seats, which are respectively arranged on left and right sides of a squat rack body, wherein two groups of first sliding shafts are arranged between the two sliding mounting seats, and the two groups of the first sliding shafts are respectively arranged on front and back sides of a squat rack; the two groups of the first sliding shafts are both fitted tightly with the squat rack body, and the two sliding mounting seats are provided with fixing mechanisms for fixing the barbell bar; and wherein the fixing mechanism comprises a fixing seat corresponding to the sliding mounting seat, and the fixing seat is fixedly connected with the sliding mounting seat; the fixing seat is provided with a mounting groove adapted to a shape of the barbell bar; a clamping seat is mounted on a top of the fixing seat, and the clamping seat is matched with the mounting groove on the fixing seat to form an annular structure adapted to the shape of the barbell bar; the clamping seat and the fixing seat are connected and fixed by an adjusting mechanism; and wherein, both the clamping seat and the fixing seat are provided with at least one second sliding shaft, wherein an axial direction of the second sliding shaft is parallel to an axial direction of the barbell bar.

2. The device for fixing the movement track of the barbell bar installed on the squat rack according to claim 1, wherein the adjusting mechanism comprises a U-shaped clipping seat; and one end of the clamping seat is hinged with the fixing seat, and the U-shaped clipping seat is fixedly connected with an other end of the clamping seat; the fixing seat is hinged with a threaded rod, and a rotating direction of the threaded rod corresponds to a position of the U-shaped clipping seat, and the threaded rod is provided with a threadedly connected nut.

3. The device for fixing the movement track of the barbell bar installed on the squat rack according to claim 2, wherein the clamping seat and the fixing seat are hinged by a hinge shaft, the clamping seat is provided with a strip groove, the hinge shaft is connected in the strip groove, and the hinge shaft is fixedly installed on the fixing seat.

4. The device for fixing the movement track of the barbell bar installed on the squat rack according to claim 3, wherein the fixing seat is provided with pin holes for connecting the hinge shaft, wherein the pin holes comprise at least two pin holes.

5. The device for fixing the movement track of the barbell bar installed on the squat rack according to claim 2, wherein at least two first pin holes are arranged along a height direction at one end of the mounting groove of the fixing seat hinged with the clamping seat.

6. The device for fixing the movement track of the barbell bar installed on the squat rack according to claim 5, wherein second pin holes corresponding to the first pin holes are arranged on the clamping seat, and the second pin holes are arranged as racetrack-shaped holes, and the fixing seat and the clamping seat are hinged through a fixing pin.

7. The device for fixing the movement track of the barbell bar installed on the squat rack according to claim 1, wherein the adjusting mechanism comprises two pin bars, at least two first pin holes are formed on both sides of the mounting groove of the fixing seat, and two ends of the clamping seat are each provided with second pin holes corresponding to the first pin holes; and dimensions of the two pin bars are matched with those of the first pin holes and the second pin holes, and movable ends of the pin bars are provided with fixing pins.

8. The device for fixing the movement track of the barbell bar installed on the squat rack according to claim 7, further comprising a collar, wherein a dimension of the collar is adapted to a dimension of the barbell bar, and the collar is sleeved and fixedly connected to the barbell bar, and a hook is connected to the collar.

9. The device for fixing the movement track of the barbell bar installed on the squat rack according to claim 8, further comprising an attachment rack attached to the squat rack body and arranged above the respective sliding mounting seat sliding mounting seat; and the attachment rack is provided with a clamping part which is fixedly connected with the attachment rack, and the clamping part is provided with an attachment groove which is used for clamping the hook.

10. The device for fixing the movement track of the barbell bar installed on the squat rack according to claim 9, wherein a plurality of first fixing holes are uniformly arranged along a length direction of the squat rack body, and second fixing holes corresponding to the first fixing holes are arranged on the attachment rack, and the squat rack body and the attachment rack are fixedly connected through an attachment member.

11. The device for fixing the movement track of the barbell bar installed on the squat rack according to claim 10, wherein the attachment rack has a cross section that is roughly U-shaped.

12. The device for fixing the movement track of the barbell bar installed on the squat rack according to claim 7, wherein a plurality of first fixing holes are uniformly arranged along a length direction of the squat rack body, and ends of the two sliding mounting seats close to the fixing mechanism are connected with locking plates; and locking holes are arranged in the locking plates, the locking holes correspond to the first fixing holes, and the locking holes extend to form locking parts with a hollow structure.

13. The device for fixing the movement track of the barbell bar installed on the squat rack according to claim 12, further comprising a collar, wherein a dimension of the collar is matched with a dimension of the barbell bar, the collar is sleeved and fixedly connected to the barbell bar, and a locking component is arranged on the collar; and the locking component comprises a locking connecting rod and a locking block, wherein one end of the locking connecting rod is hinged with the collar, and the other end of the locking connecting rod is hinged with the locking block, and the locking block is configured to slidably pass through the locking part.

14. The device for fixing the movement track of the barbell bar installed on the squat rack according to claim 1, wherein the fixing seat comprises a first pin plate, a fixing front plate and a fixing rear plate; the fixing front plate is fixedly connected with the sliding mounting seat, at least one first fixing pin hole is arranged on the fixing front plate, and at least one second fixing pin hole corresponding to the first fixing pin hole is arranged on the fixing rear plate; and first connecting parts corresponding to the first and second fixing pin holes are formed at both ends of the first pin plate, and the fixing front plate and the fixing rear plate are detachably connected through the first pin plate.

15. The device for fixing the movement track of the barbell bar installed on the squat rack according to claim 14, further comprising a rotating pin, wherein a first rotating hole is arranged in the second sliding shaft, at least one second rotating hole corresponding to the first rotating hole is arranged on the fixing front plate, and at least one third rotating hole corresponding to the second rotating hole is arranged on the fixing rear plate; and the fixing seat and the second sliding shaft are rotationally connected through the rotating pin, the first rotating hole and the second rotating hole.

16. The device for fixing the movement track of the barbell bar installed on the squat rack according to claim 15, wherein the clamping seat comprises a second pin plate, a clamping front plate and a clamping rear plate; and the clamping front plate is provided with at least one third fixing pin hole, and the clamping rear plate is provided with at least one fourth fixing pin hole corresponding to the third fixing pin hole; second connecting parts corresponding to the third fixing pin hole and the fourth fixing pin hole are formed at both ends of the second pin plate, and the clamping front plate and the clamping rear plate are detachably connected through the second pin plate.

17. The device for fixing the movement track of the barbell bar installed on the squat rack according to claim 16, wherein at least one fourth rotating hole corresponding to the first rotating hole is arranged on the clamping front plate, and at least one fifth rotating hole corresponding to the fourth rotating hole is arranged on the clamping rear plate; and the clamping seat and the second sliding shaft are rotationally connected through the rotating pin, the fourth rotating hole, the fifth rotating hole and the first rotating hole.

* * * * *